US010017997B2

(12) United States Patent
Holtz

(10) Patent No.: US 10,017,997 B2
(45) Date of Patent: Jul. 10, 2018

(54) RESONANCE-TUNED DRILL STRING COMPONENTS

(71) Applicant: Halliburton Energy Services, Inc., Houston, TX (US)

(72) Inventor: Stephen Robert Holtz, Littleton, CO (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 345 days.

(21) Appl. No.: 14/809,761

(22) Filed: Jul. 27, 2015

(65) Prior Publication Data

US 2016/0053545 A1 Feb. 25, 2016

Related U.S. Application Data

(60) Provisional application No. 62/041,531, filed on Aug. 25, 2014.

(51) Int. Cl.

| | |
|---|---|
| ***E21B 7/24*** | (2006.01) |
| ***E21B 28/00*** | (2006.01) |
| *E21B 49/00* | (2006.01) |

(52) U.S. Cl.

CPC ..... *E21B 7/24* (2013.01); *E21B 28/00* (2013.01); *E21B 49/003* (2013.01)

(58) Field of Classification Search

CPC ..... E21B 7/24; E21B 43/003; E21B 28/00

See application file for complete search history.

(56) References Cited

U.S. PATENT DOCUMENTS

| | | | | |
|---|---|---|---|---|
| 5,697,733 | A * | 12/1997 | Marsh, Jr. | E02D 3/046 172/40 |
| 6,012,521 | A * | 1/2000 | Zunkel | B09C 1/00 166/177.1 |
| 8,517,093 | B1 * | 8/2013 | Benson | E21B 1/00 166/177.1 |
| 2007/0221408 | A1 * | 9/2007 | Hall | E21B 4/06 175/57 |
| 2010/0319994 | A1 * | 12/2010 | Wiercigroch | E21B 7/24 175/56 |
| 2011/0019501 | A1 | 1/2011 | Market | |

* cited by examiner

*Primary Examiner* — D. Andrews
*Assistant Examiner* — Kristyn A Hall
(74) *Attorney, Agent, or Firm* — McDermott Will & Emery LLP

(57) ABSTRACT

A drilling system includes a drill string extendable into a wellbore penetrating a subterranean formation. The subterranean formation exhibits a resonant frequency and a drill bit is coupled to a distal end of the drill string. A vibration sub is positioned within the drill string adjacent the drill bit for generating vibration stress waves at the drill bit, and the vibration stress waves exhibit a vibration frequency that approximates the resonant frequency.

11 Claims, 8 Drawing Sheets

RESONANCE-TUNED DRILL STRING COMPONENTS

BACKGROUND

Wellbores are formed in subterranean formations for various purposes including, for example, the extraction of oil and gas and the extraction of geothermal heat. Such wellbores are typically formed using one or more drill bits, such as fixed-cutter bits (i.e., "drag" bits), rolling-cutter bits (i.e., "rock" bits), diamond-impregnated bits, natural diamond and hybrid bits, which may include, for example, both fixed cutters and rolling cutters. The drill bit is coupled either directly or indirectly to an end of a drill string or work string, which encompasses a series of elongated tubular segments connected end-to-end that extends into the wellbore from the surface. The wellbore is formed by rotating the drill bit so that its associated cutters or abrasive structures cut, crush, shear, and/or abrade away the formation materials, thereby facilitating the advancement of the drill bit into the subterranean formation.

As the drill bit progresses, differing formations formed of differing rock types that exhibit unique or differing hardness are often encountered. Relatively harder rock types can cause a drill bit to wear faster and can cause a slower drilling rate.

Moreover, the drill string is made of elastic materials, such as steel tubing, which are deformable under torsion. During drilling, the drill string can be elastically twisted by varying amounts, up to several full 360-degree revolutions, because of torsion created by the driving rotational force on the drill string and/or bit and the friction on the drill bit as it engages the underlying rock. The drill string also displays a complicated dynamic behavior comprising axial, lateral and torsional vibrations. In extreme cases, the torsional part becomes so large that the drill bit periodically comes to a complete standstill, during which the drill string is torqued-up until the drill bit suddenly rotates again at an angular velocity that is much higher than the angular velocity measured at the surface. This phenomenon is known as stick-slip, which causes excessive and unwanted vibrations for a drill string in the torsional direction.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to wellbore operations and, more particularly, to enhancing drill bit penetration using the resonant frequency of the rock material being drilled.

The resonant frequency of a subterranean formation being drilled may be determined in real time during drilling (and/or measured or modeled and preprogrammed prior to drilling) and vibrations may be induced in the drill string at or near the determined resonant frequency. In some embodiments, the vibrations may be introduced into the drill string at or near a drill bit or at any other location along a bottom-hole assembly included in the drill string. Thus, the frequency of the induced vibrations may be continuously or periodically updated as the drill bit penetrates various rock materials during drilling operations.

Figure 1A:
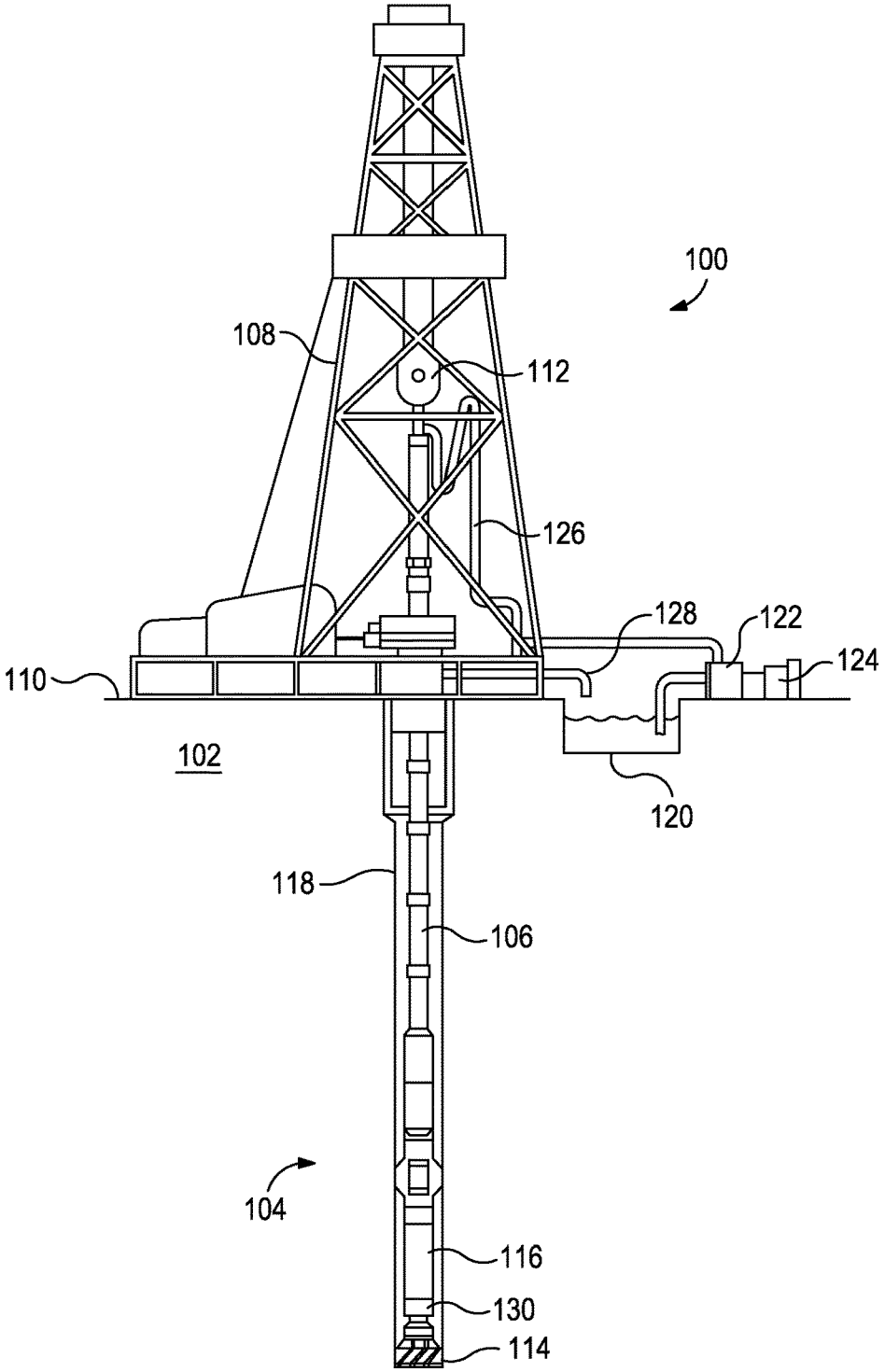
FIG. 1A depicts a drilling system that can employ the principles of the present disclosure.

Referring to FIG. 1A, illustrated is an exemplary drilling system 100 that may employ one or more principles of the present disclosure. Boreholes may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick 108 arranged at the surface 110. The derrick 108 includes a kelly 112 used to lower and raise the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions, and/or vibration inducing elements such as, but not limited to, acoustic vibrators and mechanical vibration inducing elements. In other embodiments, the measurement tools and/or vibration inducing elements may be self-contained within the tool string 116 and/or a separate vibration sub 130 may be disposed adjacent the drill bit, as shown in FIG. 1A.

Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process returns drill cuttings and debris to the surface. The cuttings and mud mixture are passed through a flow line 128 and are processed such that a cleaned mud is returned down hole through the stand pipe 126 once again.

Although the drilling system 100 is shown and described with respect to a rotary drill system in FIG. 1A, those skilled in the art will readily appreciate that many types of drilling systems can be employed in carrying out embodiments of the disclosure. For instance, drills and drill rigs used in embodiments of the disclosure may be used onshore (as depicted in FIG. 1A) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Figure 1B:
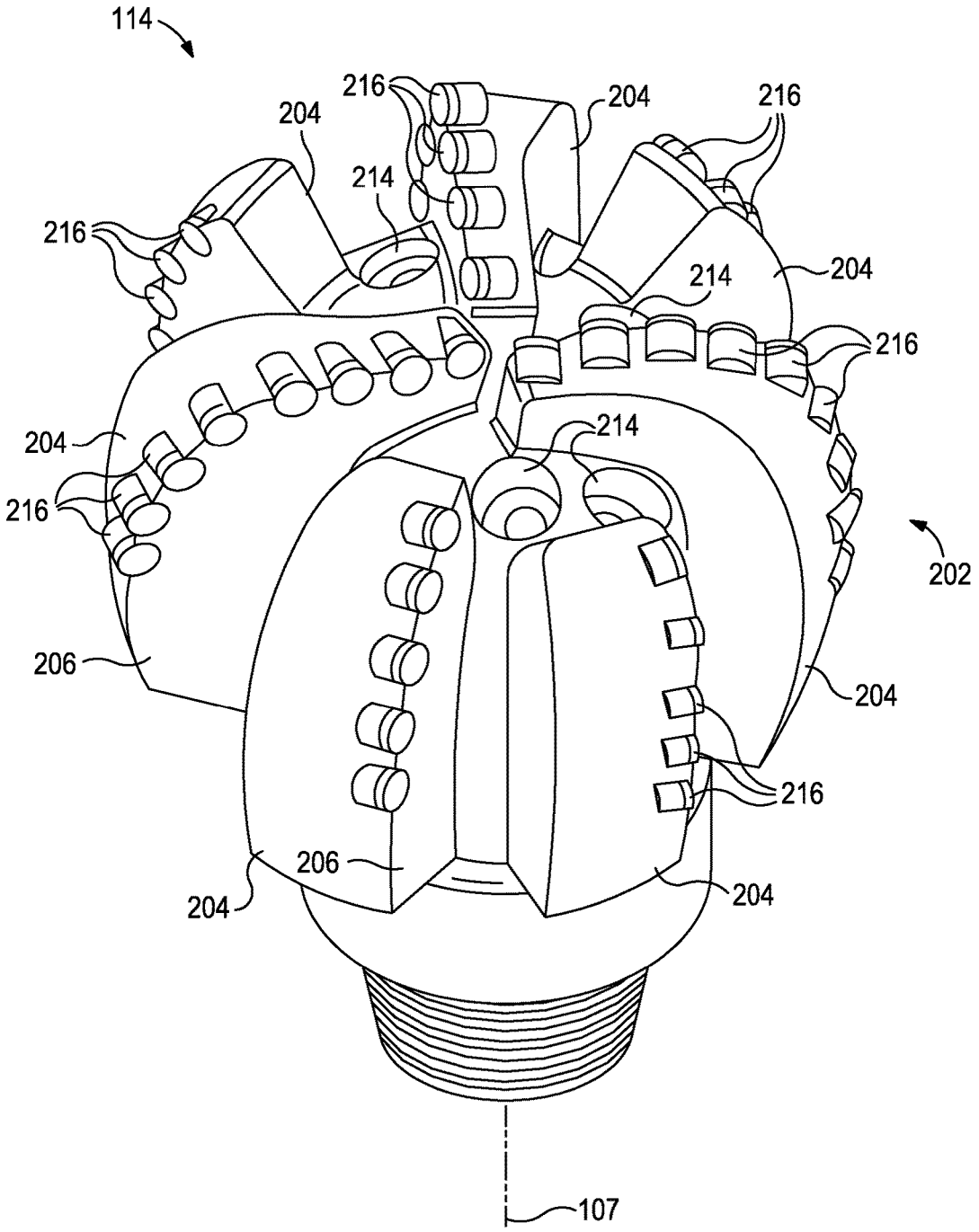
FIG. 1B depicts a drill bit that can employ the principles of the present disclosure.

Referring to FIG. 1B, illustrated is an isometric view of a drill bit 114 that may be used in carrying out the principles of the present disclosure. The drill bit 114 used in the presently described embodiments may comprise any fixed cutter drill bit, including polycrystalline diamond compact (PDC) drill bits, drag bits, matrix drill bits, and/or steel body drill bits. Moreover, while depicted in FIG. 1B as a fixed cutter drill bit, the principles of the present disclosure are equally applicable to other types of drill bits operable to form a wellbore including, but not limited to, roller cone drill bits and reamers (hole openers).

The drill bit 114 has a bit body 202 that includes radially and longitudinally extending blades 204 having leading faces 206. The bit body 202 may be made of steel or a matrix of a harder material, such as tungsten carbide. The bit body 202 rotates about a longitudinal drill bit axis 107 to drill into a subterranean formation under an applied weight-on-bit. Corresponding junk slots 212 are defined between circumferentially adjacent blades 204, and a plurality of nozzles or ports 214 can be arranged within the junk slots 212 for ejecting drilling fluid that cools the drill bit 114 and otherwise flushes away cuttings and debris generated while drilling. The bit body 202 may have an outer edge 271.

The bit body 202 further includes a plurality of cutters 216 disposed within a corresponding plurality of cutter pockets sized and shaped to receive the cutters 216. Each cutter 216 in this example is more particularly a fixed cutter, secured within a corresponding cutter pocket via brazing, threading, shrink-fitting, press-fitting, snap rings, or the like. The fixed cutters 216 are held in the blades 204 and respective cutter pockets at predetermined angular orientations and radial locations to present the fixed cutters 216 with a desired back rake angle against the formation being penetrated. As the drill string is rotated, the fixed cutters 216 are driven through the rock by the combined forces of the weight-on-bit and the torque experienced at the drill bit 114. During drilling, the fixed cutters 216 may experience a variety of forces, such as drag forces, axial forces, reactive moment forces, or the like, due to the interaction with the underlying formation being drilled as the drill bit 114 rotates.

According to embodiments of the present disclosure, vibrations (sometimes referred to herein as stress waves) may be induced in the drill bit 114 with a vibration frequency at or near the determined resonant frequency of the particular formation being drilled. All subterranean formations exhibit a resonant frequency. From sonic logging, other known logging techniques, and/or other frequency determination techniques (e.g., drilling noise analysis techniques) a well operator or downhole system is able to obtain and otherwise measure the resonant frequency of a subterranean formation being penetrated during a drilling operation. In the present disclosure, systems and methods are described herein that tune a downhole tool to the resonant frequency of a given subterranean formation and thereby reduce the effective rock strength of the subterranean formation and also improve drill bit life.

In one embodiment, to determine the resonant frequency, one or more acoustic transducers such as microphones may be included in the drill string 106 and configured to continuously or intermittently gather drilling noise data. Processing components included in the BHA 104 or at the surface 110 may be used to extract and otherwise determine the resonant frequency of the formation based on the responses received by such acoustic transducers. The drilling noise may be recorded by a plurality of spaced acoustic transducers integrated with or attached to different components of the BHA 104. Various components of the gathered drilling noise data may be separated, such as in a frequency transform analysis, and categorized as rock contact noise and mechanical noise.

To categorize different components of the recorded drilling noise, a comparative analysis of frequency and/or power spectrum components of drilling noise recorded by different acoustic transducers may be performed. Such comparative analysis may be performed downhole or uphole. Example categories for drilling noise components include, but are not limited to, rock contact noise, mechanical noise, and fluid flow noise. Further, each drilling noise category may include sub-categories. For example, rock contact noise may be further categorized as stabilizer contact noise or drill bit contact noise. In addition, mechanical noise may be further categorized as mud motor noise, contact velocity assembly noise, and bearing assembly noise. A data log, a plan, or a control signal may be derived based on the categorized drilling noise components. The rock contact noise may include information indicating the resonant frequency of the rock being drilled. In this way, the resonant frequency may be determined by "listening" to the sound of drilling.

Figure 2:
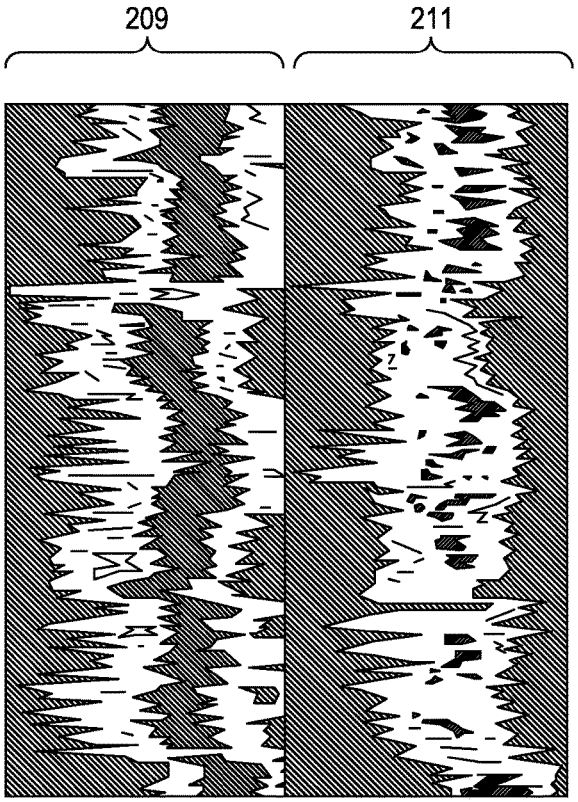
FIG. 2 depicts side-by-side well logging readouts obtained from a subterranean formation.

FIG. 2 depicts side-by-side well logging readouts 209 and 211 obtained from a subterranean formation using a sonic logging while drilling (LWD) tool. Subterranean formations can be described as "fast" formations and "slow" formations. A fast formation tends to be dense and transmits vibration/sonic signals faster than a slow formation, which exhibits a lower density. Fast subterranean formations favor high frequency and slow subterranean formations favor low frequency. Small diameter wellbores favor high frequency and large diameter wellbores favor low frequency. Compressional and refracted shear formations favor low frequency. The formation being monitored in the first and second readouts 209, 211 exhibits a resonant frequency of approximately 6-8 kHz, thereby classifying the formation as a slow formation.

The first logging readout 209 was derived from an 8 kHz source, and the second logging readout 211 was derived from a 12 kHz source. It is noted that the log quality of first logging readout 209 is much better as compared to the log quality of the second logging readout 211. The difference in readout quality may be related to the fact that the 8 kHz source is closer to the resonant frequency of the particular formation, as compared to the 12 kHz source frequency. Thus, the quality of the log at various source frequencies can be used to determine the resonant frequency of the formation being drilled.

Logging readouts may be continuously, periodically, or randomly obtained using various source frequencies and can be processed during drilling operations to determine the resonant frequency of the formation being drilled as the wellbore progresses. According to the present disclosure, vibrations or other stress waves may then be generated at the resonant frequency at or near the drill bit 114 (FIGS. 1A-1B). In this way, stress waves may be induced through the drill bit 114 to the formation to weaken and/or destroy bonds holding together components of the formation, and thereby increasing the ease, speed, and reliability of drilling operations.

Figure 3A:
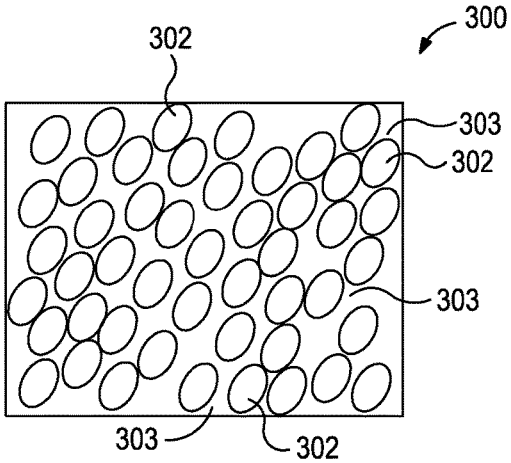
FIGS. 3A-3E depict an example sandstone matrix and show how the materials of the sandstone matrix may be affected by an input of a stress wave.
Figure 3B:
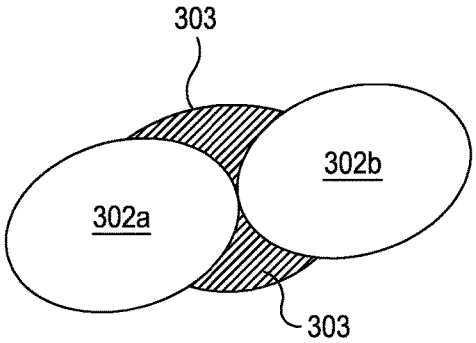

FIGS. 3A-3E depict an example sandstone matrix 300 and how the materials of the sandstone matrix may be affected by an input of a stress wave at the resonant frequency of the matrix. In FIG. 3A, the sandstone matrix 300 is depicted as being formed from a stationary matrix of grains 302 (e.g., quartz grains) and cementitious material 303 that bonds the grains 302 together. Because the matrix 300 is stationary, there is low energy in the matrix 300. In FIG. 3B, an enlarged view of two quartz grains 302A and 302B of the sandstone matrix 300 are shown. The grains 302A and 302B are coupled together with the cementitious material 303.

Figure 3C:
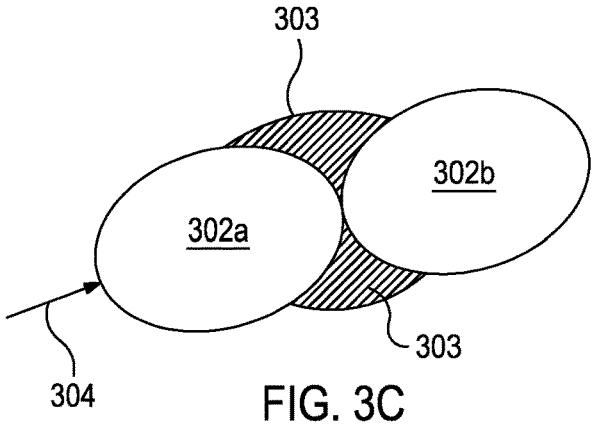
Figure 3D:
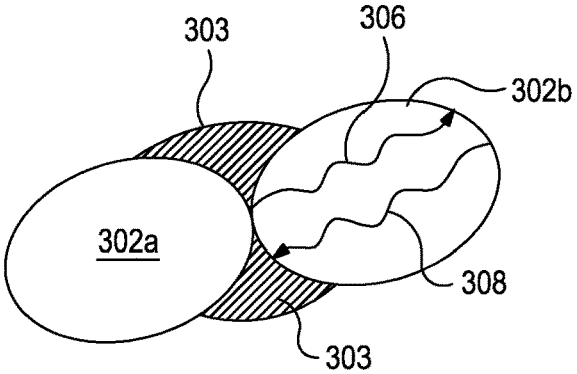

As shown in FIG. 3C, a force 304 may be provided to grain 302A, which experiences a change in the forces acting on it and moves a small distance relative to the grain 302B and over a small period of time. According to the present disclosure, the force 304 may be provided by a vibrating drill bit, as described herein below. As shown in FIG. 3D, the energy 306 assumed by grain 302A will travel through to the grain 302B and a portion 308 of the energy will be reflected back toward grain 302A. A portion 310 of the returned energy 208 may be transmitted through grain 302A and another portion 312 reflected within grain 302A back toward grain 302B as shown in FIG. 3E.

Figure 3E:
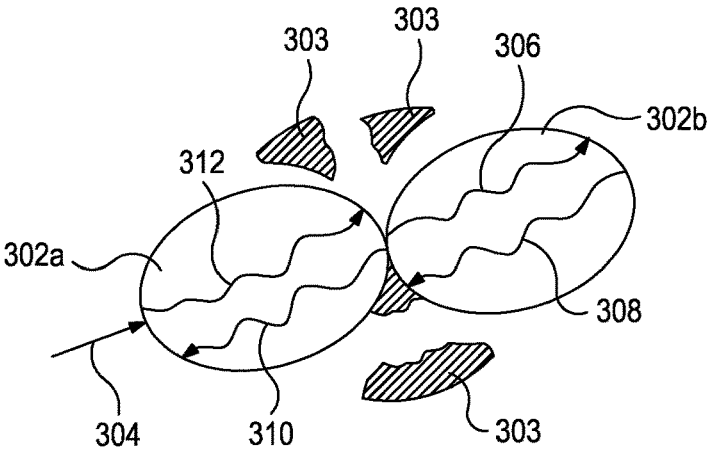

As shown in FIG. 3E, if the force 304 is provided with a frequency of continuous input vibrations that matches or nearly matches the inverse of travel time (or a harmonic thereof) of the energy 306/308 through a common grain, the energy in each grain will grow until the cementitious material 303 between each grain fails and the grains separate. In this way, the formation (e.g., the sandstone matrix 300 in the example of FIGS. 3A-3E) can be softened, weakened, or even effectively liquefied to ease or replace the action of cutters 216 (FIG. 1B) in drilling the formation.

Figure 4:
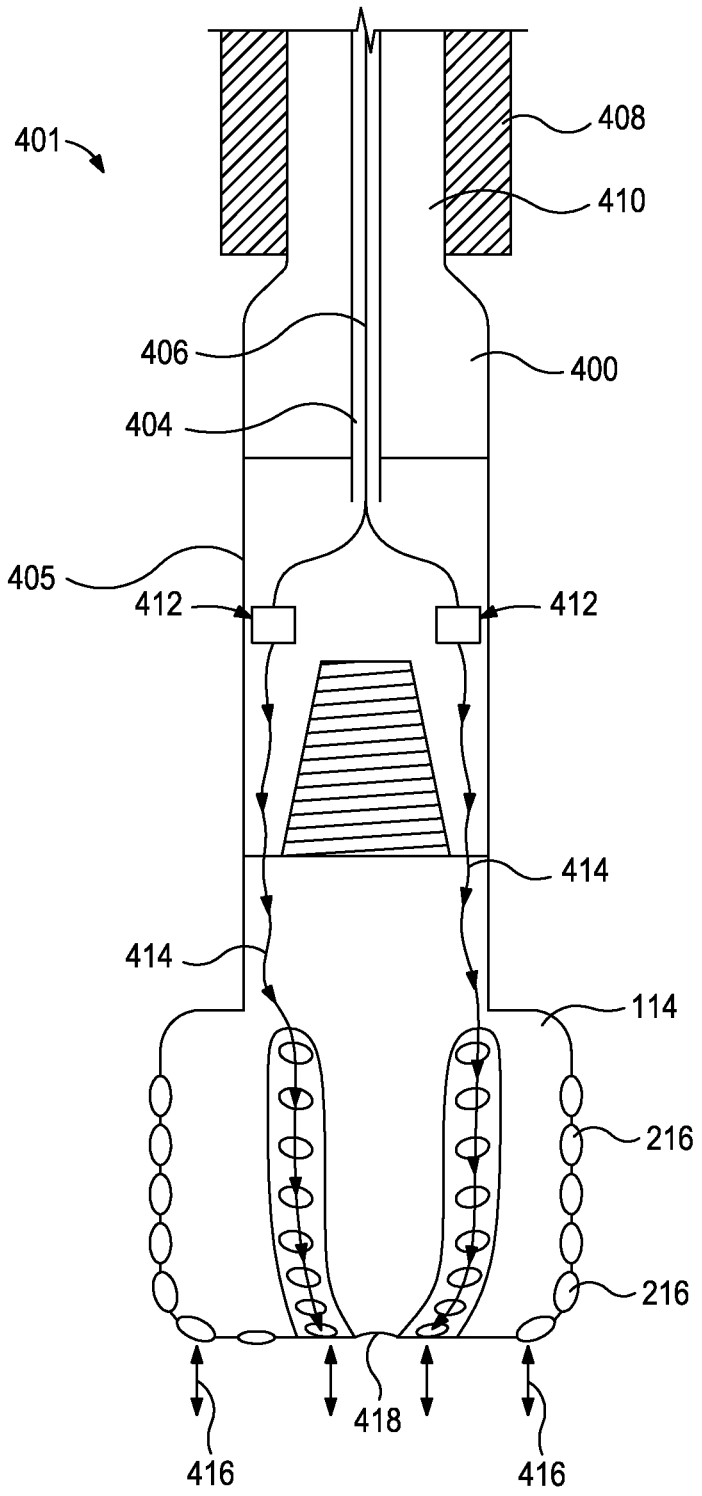
FIG. 4 depicts an exemplary drilling system that incorporates an acoustic stress wave system used to match the resonant frequency of the rock being drilled.

FIG. 4 is a schematic diagram of an exemplary drilling system 401 that incorporates an acoustic stress wave system used to match or substantially match the resonant frequency of the rock being drilled, according to one or more embodiments. The drilling system 401 may include a drive shaft 410 that is coupled to a drill bit 114 at a bit box 400. The drive shaft 410 may include a radial bearing pack 408 used to assume radial loads experienced by the drive shaft 410 during operation. A downhole motor (e.g., a mud motor, not shown) may be provided above the bearing pack 408. A conduit 404 may be defined through the drive shaft 410 to extend an electronic feed-through wire 406 to an acoustic sub 405 positioned within or otherwise coupled to the drive shaft 410. The electronic feed-through wire 406 may provide electrical power to an acoustic sub 405 and, more particularly, to one or more acoustic vibrators 412 included in the acoustic sub 405.

The acoustic vibrators 412 may each include one or more vibration inducing devices configured to impart sound vibrations (waves) to the drill bit in the general direction of the arrows 414. Suitable vibration inducing devices that may be used as an acoustic vibrator 412 may include, but are not limited to, a speaker, a piezoelectric device, an acoustic transducer, or a combination thereof. The acoustic vibrators 412 may comprise various types of materials and components for converting electrical signals to vibrational energy to be transmitted to the drill bit 114. For example, acoustic vibrators 412 may receive electrical signals at a desired frequency (e.g., at or near the determined resonant frequency of the formation being drilled) and, via one or more gain or amplifier arrangements and/or one or more transducers, may convert the electrical signals into sound waves. This may be accomplished, for example, by using magnets, electromagnets, piezoelectric elements, piezoceramic elements, micro-electro-mechanical (MEMS) elements, electrorestrictive elements, magnetorestrictive elements, ceramic elements, and/or flexible membranes.

In one embodiment, acoustic vibrators 412 may include a common transducer or one or more additional transducers may be provided to operate as a microphone (for converting sound energy to electrical energy) for determining the resonant frequency of a formation being drilled. However, this is merely illustrative and if desired, the resonant frequency may be determined using a separate LWD or MWD tool in the drill string.

In operation, the drill bit 114 may engage the wellbore with the cutters 216 disposed thereon along the outer edge and/or at the crown 418. The acoustic vibrators 412 in the acoustic sub 405 may be activated and send acoustic vibrations (i.e., high frequency sound waves) toward the crown 418 of the drill bit 114. The acoustic vibrations may be tuned to provide stress waves approximating the resonant frequency of the formation rock being drilled by causing, for example, vibrations at the surface of the drill bit (as indicated by arrows 416). As a result, and based on prior or real-time measured resonant frequencies of the subterranean formation being drilled, the acoustic vibrations may be configured to reduce the effective rock strength of the formation such that the drill bit 114 may be able to more effectively drill through the rock. As a result, the useful life of the drill bit 114 may be improved.

Figure 5:
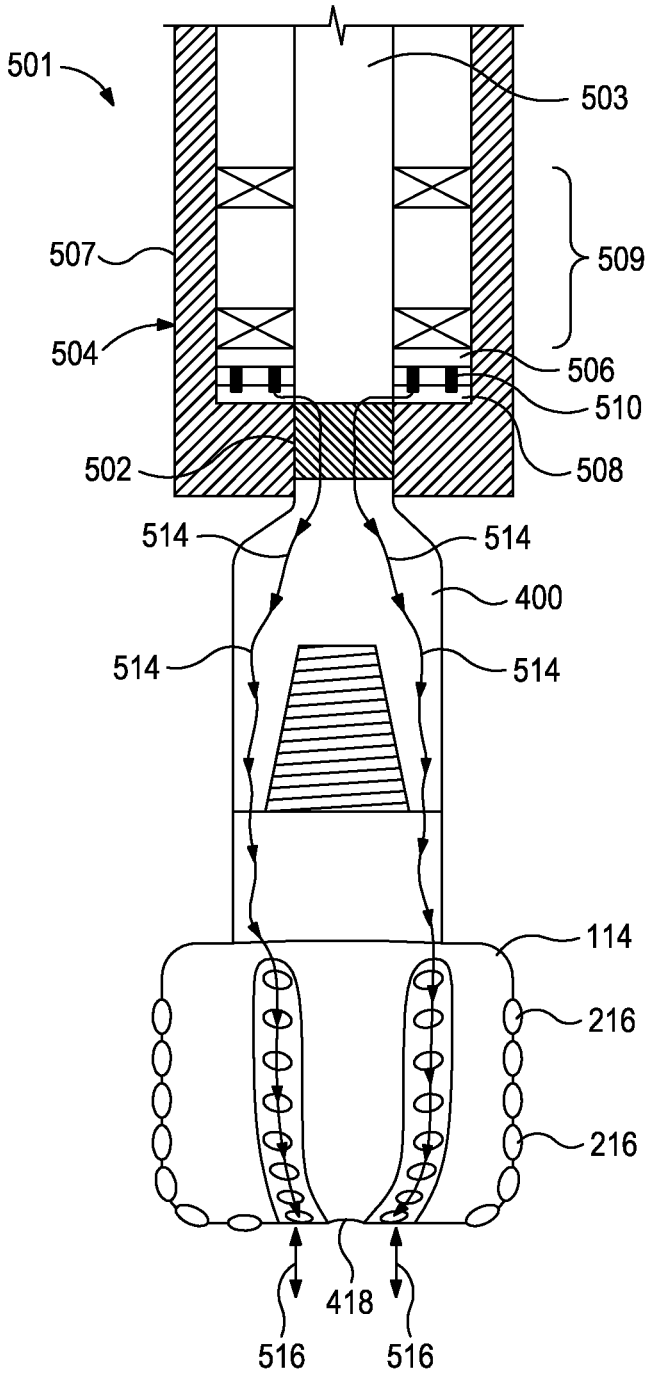
FIG. 5 depicts an exemplary drilling system that incorporates a mechanical stress wave system used to match the resonant frequency of the rock being drilled.

FIG. 5 depicts an exemplary drilling system 501 that incorporates a mechanical stress wave system used to match the resonant frequency of the rock being drilled, according to one or more embodiments. As illustrated, the drilling system 501 may include a drive shaft 503 and a vibration sub 504 arranged about the drive shaft 503. The vibration sub 504 may include a housing 507, a first plate 506, a second plate 508, a bearing assembly 509, and one or more protrusions 510 arranged between the first and second plates 506 and 508. As discussed in further detail hereinafter in connection with FIGS. 6 and 7, protrusions 510 may be defined on one or both of plates 506 and 508, or may alternatively comprise other features defined on the plates 506, 508 that are able to cooperatively generate vibrations at a desired frequency when rotated against each other.

The first plate 506 may be fixed to the housing 507 and may include an uneven surface that includes, for example, a series of features such as angularly spaced dimples, nubs, indents or protrusions defined therein. The second plate 508 may be rotationally fixed to the drive shaft 503 and may have an uneven surface that includes, for example, a series of features such as angularly spaced dimples, nubs, indents or protrusions defined therein. The bearing assembly 509 may include, for example, one or more ball bearings with associated races (not expressly shown) and may be configured to allow the drive shaft 503 to rotate within the housing 507.

In some embodiments, the driveshaft is constructed with a polygon-shaped section 502, such as an octagon, that allows torque to be transmitted from the power section to bit box 400 while the motor housing 507 remains stationary. A downhole motor (e.g., a mud motor, not shown) may be provided above the bearing pack 509 and may be operatively coupled to the drive shaft 503 and configured to rotate the drive shaft 503 and thereby rotate the drill bit 114.

In exemplary operation, the drill bit 114 may engage the wellbore with the cutters 216 disposed thereon at select locations. As the drive shaft 503 rotates, the second plate 508 correspondingly rotates with respect to the first plate 506. As the protrusions 510 between first plate 506 and second plate 508 engage each other due to the rotation of second plate 508, a mechanical vibration may be generated and sent toward the crown 418 of the drill bit.

Figure 6:
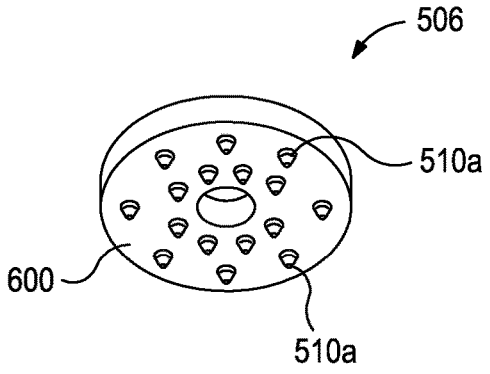
FIG. 6 depicts a perspective view of an illustrative top plate for a mechanical stress wave system.
Figure 7:
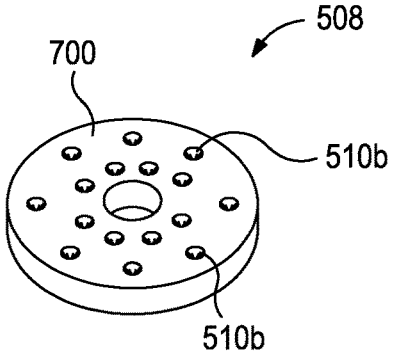
FIG. 7 depicts a perspective view of an illustrative bottom plate for a mechanical stress wave system.

FIG. 6 is a perspective bottom view of plate 506 showing an uneven surface 600 having features 510A. Features 510A may include angularly spaced dimples, nubs, indents or protrusions on surface 600. FIG. 7 is a perspective top view of plate 508 showing an uneven surface 700 having features 5106. Features 5106 may include angularly spaced dimples, nubs, indents or protrusions on surface 700 that may interact with features 510A on surface 600 (FIG. 6) of plate 506.

In one embodiment, features 510A of plate 506 may include angularly spaced protrusions and features 5106 of plate 508 may include angularly spaced indents. The protrusions on plate 506 may move into and out of the indents on plate 508 while the plate 508 rotates during operation. In another embodiment, features 5106 of plate 508 may include angularly spaced protrusions and features 510A of plate 506 may include angularly spaced indents. The protrusions on plate 508 may move into and out of the indents on plate 506 while the plate 508 rotates during operation. In another embodiment, both features 510A and 5106 may be protrusions that contact each other during rotation of plate 508.

Figure 8:
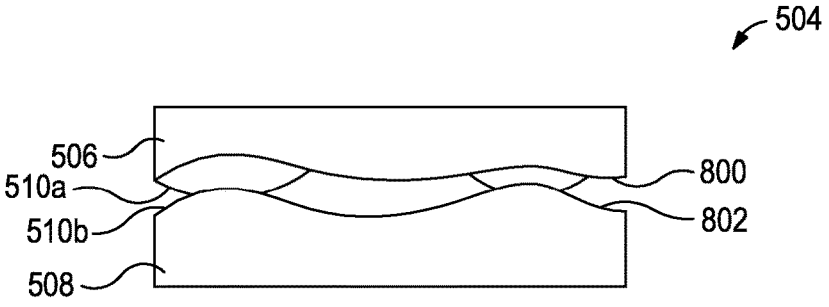
FIG. 8 depicts a side view of illustrative top and bottom plates having undulating surfaces for a mechanical stress wave system.

In another embodiment, both features 510A and 5106 may be misaligned undulations with curved or smooth surfaces that allow the plate 506 to smoothly rise and fall with respect to the plate 508 during rotation of plate 508. For example, and with reference to FIG. 8, features 510A and 5106 may be formed from respective undulating surfaces 800 and 802. In any case, the interaction of features 510A and 5106 may impart a mechanical stress wave that are able to travel in the direction generally indicated by the arrows 514 and toward the crown 418 of the drill bit 114. The vibrations may cause the drill bit 114 to vibrate and otherwise oscillate as indicated by arrows 516.

The angular spacing of the features 510A and 510B on first and second plates 506 and 508 may be tuned to generate mechanical vibrations that comprise stress waves approximating the resonant frequency of the formation being drilled. Accurately tuning the first and second plates 510A,B to approximate the resonant frequency of a particular formation may be based on a known rotation rate (RPM) of the plate 508 with respect to the plate 506, and based on prior or real-time measured resonant frequency of the formation. Pairs of plates may be designed and fabricated to generate vibrations at a particular vibration frequency at given rotation rate. When the formation resonant frequency is known, a corresponding pair of plates with features configured to generate vibrations at that frequency may be selected and installed adjacent the drill bit 114 in the drill string 106 (FIG. 1A) prior to introducing of the drill string 106 into the wellbore. As a result, the generated mechanical vibrations may be configured to reduce the effective rock strength of the subterranean formation being drilled such that the drill bit 114 may be able to more effectively drill through the rock. Moreover, as a result, the useful life of the drill bit 114 may be improved.

The mechanical stress wave system embodiment of FIG. 5 may be a relatively less complex vibration inducing system that can be useful when the resonant frequency of the formation to be drilled is known (e.g., measured or estimated) prior to drilling the formation. For example, when drilling a horizontal portion of a wellbore, the formation characteristics (e.g., the resonant frequency) may not change because the drill bit 114 is extending horizontally through a single material rather than passing vertically through different formations. Thus, given the known resonant frequency, first and second plates 506 and 508 that have features 510A and 510B that will generate vibrations at or near the resonant frequency (given the known rotation rate of plate 508 with respect to plate 506) may be selected and mounted to the drill string 106 (FIG. 1A) so that resonant vibrations are constantly generated at the drill bit 114. However, this is merely illustrative. In other embodiments, features 510A and/or 510B may be adjustable (e.g., actuatable) features that can be moved (e.g., extended in or out of the plates) to form a pattern of features that are tuned to generate vibrations at, for example, a real-time determined resonant frequency.

Another potential embodiment to enable stress-wave generation at the drill bit 114 may include using electronics that incorporate pulsers and receivers. For example, a pulser/receiver in the BHA 104 (FIG. 1A) may be used to generate an acoustic vibration in one or more components of the BHA 104 by generating electrical pulses with the pulser/receiver which are used to generate corresponding acoustic pulses with a transducer. The transducer may be coupled to a housing or body surface of the BHA 104. In some embodiments, the pulser/receiver may be alternately used to determine properties of the formation (e.g., the resonant frequency) by processing and analyzing reflected signals received at the transducer. In various embodiments, one or more transducers may be coupled to corresponding surfaces in the BHA 104 for generating stress waves that travel through the drill bit 114 as discussed herein.

In another embodiment, stress waves may be generated in the BHA 104 (FIG. 1A) using a down-hole tone-burst generator that may be positioned on or otherwise arranged in the BHA 104. One or more tone-burst generators may be provided in the BHA 104 and configured to receive a low-voltage signal and convert the low voltage signal into a high-power pulse train. In this way, bursts of acoustic energy may be transmitted into a housing or body structure of the BHA 104 to be transmitted to the formation through the drill bit 114 as discussed herein. A tone-burst generator may be provided with relatively high power radio frequency (RF) burst capability thereby facilitating acoustic vibration induction in the BHA 104 using attenuative materials or relatively inefficient transducers, such as electromagnetic acoustic transducers (EMATs).

In another embodiment, a magnetorestrictive material, such as Terfenol-D, may be provided in an acoustic transducer in the BHA 104 (FIG. 1A) or may be directly formed on a housing or body structure of the BHA 104. Magnetic signals applied to the magnetorestrictive material may cause the magnetorestrictive material to move and/or deform to generate acoustic vibrations (e.g., stress waves) in the surface to which the magnetorestrictive material is coupled that then travel to the drill bit 114. For example, one or more layers of Terfenol-D may be formed on a surface of the bit box 400 of FIG. 4, the housing 507 of FIG. 5, and/or on the drill bit 114. Magnetic signals of a desired frequency generated, for example, by an electromagnetic source mounted in the bit box 400 or elsewhere in the BHA 104, may cause the Terfenol-D to move or deform to generate acoustic vibrations in the drill bit at the desired frequency (e.g., at the resonant frequency of the formation being drilled).

The present embodiments may prove advantageous for several reasons. For instance, inducing vibrations at the drill bit 114 can aid in breaking off cuttings into smaller pieces, rather than having the drill bit 114 take large, long cuttings off the bottom of the hole. Moreover, the stress-wave generation may be 'tuned' to the rock properties and in-situ stress state. In one embodiment, the 'tuning' may include tuning the stress-wave frequency to the rock being destroyed by the outer cutters of the drill bit 114. As rock is removed from the bottom of the wellbore, the stress state at the bottom of the wellbore changes such that the center of the wellbore has a different stress state than the outer radial edge of the wellbore. This difference in stress state will lead to a difference in the resonant frequency of the rock (possibly a big enough difference such that the system could be tuned for the rock on the outer edge of the wellbore). The resonant frequency of the formation may be determined for a portion of the formation proximate a side of the drill bit 114 and the frequency of vibrations generated in the drill bit 114 can be adjusted to the resonant frequency proximate the side. This would allow for a decreased wear-rate or occurrence of damage on the outer cutters, which typically receive the most damage and wear.

Figure 9:
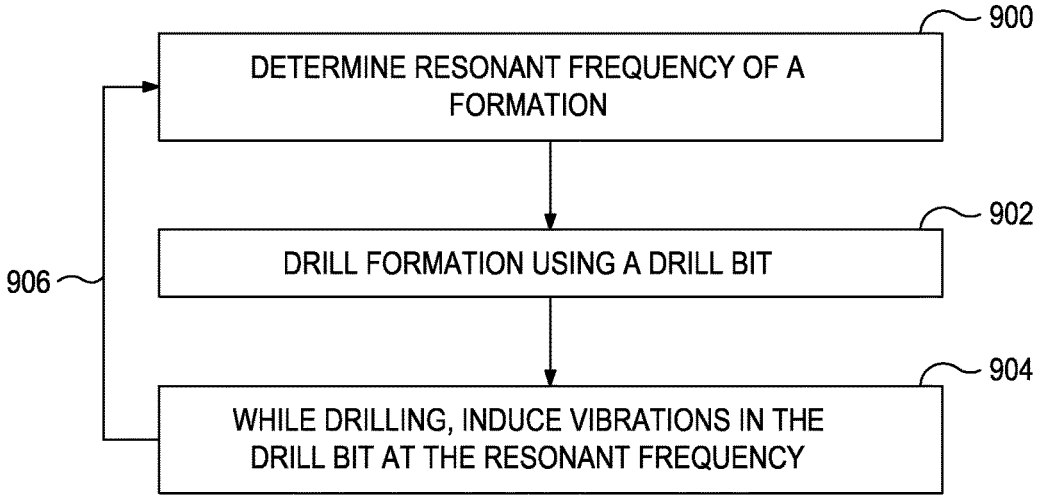
FIG. 9 depicts a flow chart of illustrative operations that may be performed for acoustically enhanced drilling in accordance with an embodiment.

FIG. 9 is a schematic flow chart of a method for resonant frequency drilling of a formation, according to one or more embodiments. At block 900, the resonant frequency of a formation may be determined. In some embodiments, the resonant frequency may be determined prior to drilling the formation. In other embodiments, the resonant frequency may be determined in real-time while drilling the formation. Determining the resonant frequency of the formation may include sending various acoustic signals into the formation at various frequencies, and measuring a reflected acoustic response (e.g., in a logging readout for each frequency) or may include listening to drilling operations with a microphone in the BHA and extracting the resonant frequency from the drilling noise. The measured reflected acoustic signals may be processed to determine the resonant frequency. MWD and/or LWD tools may be used to generate logging readouts at various frequencies and the quality of the readout may be determined using downhole processing equipment and/or processing equipment or operator analysis at a surface location. The frequency corresponding to the highest quality readout may be determined to be the resonant frequency. However, this is merely illustrative and it should be appreciated that the resonant frequencies may be determined from the acoustic responses without generating a logging readout.

At block 902, the formation may be drilled using a drill bit (e.g., the drill bit 114 illustrated herein). Drilling the formation may include rotating the drill bit with a downhole motor and/or by rotating a drill string from a surface location, where the drill bit is coupled to the end of the drill string.

At block 904, while drilling, vibrations may be induced at the drill bit at the determined resonant frequency. The vibrations may be generated using any of the embodiments and configurations described herein, and any combination thereof. For instance, vibrations may be generated using acoustic, mechanical, piezoelectric, or other vibration inducing elements that are tuned to the resonant frequency of the formation. As indicated by arrow 906, the operations of blocks 900, 902, and 904 may then be repeated, as needed. For example, vibration operations associated with block 904 may be stopped while a new determination of the resonant frequency of the formation being drilled is made. The vibration operations may then be resumed with the frequency of vibrations adjusted or not based on the new determination of the resonant frequency (e.g., based a determination of whether the resonant frequency of the formation being drilled has changed). New determinations of the resonant frequency may be obtained periodically, responsive to an operator instruction from the surface, at pseudo-random intervals, or based on known or expected changes in the formation during drilling.

Embodiments disclosed herein include:

A. A drilling system that includes a drill string extendable into a wellbore penetrating a subterranean formation, wherein the subterranean formation exhibits a resonant frequency, a drill bit coupled to a distal end of the drill string, and a vibration sub positioned within the drill string adjacent the drill bit for generating vibration stress waves at the drill bit, wherein the vibration stress waves exhibit a vibration frequency that approximates the resonant frequency.

B. A method that includes introducing a drill string into a wellbore that penetrates a subterranean formation, wherein the subterranean formation exhibits a resonant frequency and a drill bit is positioned at a distal end of the drill string, rotating the drill bit to engage the subterranean formation, and generating vibration stress waves with a vibration sub positioned within the drill string adjacent the drill bit, wherein the vibration stress waves are generated at a vibration frequency that approximates the resonant frequency.

Each of embodiments A and B may have one or more of the following additional elements in any combination: Element 1: wherein the vibration sub includes one or more acoustic devices that generate acoustic vibration stress waves. Element 2: wherein the one or more acoustic devices comprise at least one of a speaker, a piezoelectric device, and an acoustic transducer. Element 3: wherein the vibration sub comprises a housing disposed about a drive shaft that rotates the drill bit, a first plate fixed to the housing and including a first uneven surface having first surface features, and a second plate rotationally fixed to the drive shaft and including a second uneven surface having second surface features, wherein, as the drive shaft rotates, the second plate correspondingly rotates relative to the first plate and engagement of the first and second surface features generate mechanical vibration stress waves in the drill bit. Element 4: wherein the first and second surface features are selected from the group consisting of undulations, indents, and protrusions. Element 5: wherein the first and second surface features are defined on the respective first and second uneven surfaces so that, during rotation of the second plate, the first and second surface features mutually engage with a frequency that generates the mechanical vibration stress waves at the resonant frequency.

Element 6: wherein generating the vibration stress waves with the vibration sub comprises generating acoustic vibration stress waves with one or more acoustic devices included in the vibration sub. Element 7: wherein the vibration sub includes a housing disposed about a drive shaft that rotates the drill bit, a first plate fixed to the housing and including a first uneven surface having first surface features, and a second plate rotationally fixed to the drive shaft and including a second uneven surface having second surface features, the method further comprising rotating the second plate relative to the first plate as the drill bit rotates, and engaging the first surface features with the second surface features and thereby generating mechanical vibration stress waves. Element 8: wherein the first and second surface features are positioned on the respective first and second uneven surfaces so that, during rotation of the second plate, the first and second surface features engage at a frequency that generates the mechanical vibration stress waves at the resonant frequency. Element 9: further comprising determining the resonant frequency of the subterranean formation prior to introducing the drill string into the wellbore, and selecting the first and second plates to have the first and second surface features that will generate the mechanical vibration stress waves at the resonant frequency. Element 10: further comprising determining the resonant frequency of a portion of the subterranean formation proximate the drill bit during drilling, and adjusting the vibration frequency to the resonant frequency of the portion of the subterranean formation proximate the drill bit. Element 11: wherein determining the resonant frequency of the portion of the subterranean formation proximate the drill bit comprises determining the resonant frequency of the portion of the subterranean formation proximate a side of the drill bit. Element 12: wherein adjusting the vibration frequency to the resonant frequency of the portion of the subterranean formation proximate the drill bit comprises adjusting the vibration frequency to the resonant frequency of the portion of the subterranean formation proximate the side of the drill bit.

By way of non-limiting example, exemplary combinations applicable to A and B include: Element 1 with Element 2; Element 3 with Element 4; Element 3 with Element 5; Element 7 with Element 8; Element 8 with Element 9; Element 10 with Element 11; and Element 11 with Element 12.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A drilling system, comprising:

a drill string extendable into a wellbore penetrating a subterranean formation, wherein the subterranean formation exhibits a resonant frequency;

a drill bit coupled to a distal end of the drill string; and a vibration sub positioned within the drill string adjacent the drill bit for generating vibration stress waves at the drill bit, wherein the vibration stress waves exhibit a vibration frequency that approximates the resonant frequency, wherein the vibration sub comprises:

a housing disposed about a drive shaft that rotates the drill bit;

a first plate fixed to the housing and including a first surface having protrusions; and a second plate rotationally fixed to the drive shaft and including a second surface having dimples, wherein, as the drive shaft rotates, the second plate correspondingly rotates relative to the first plate and the protrusions on the first plate move into and out of the dimples on the second plate to generate the vibration stress waves.

2. The drilling system of claim 1, wherein the vibration sub includes one or more acoustic devices that generate acoustic vibration stress waves.

3. The drilling system of claim 2, wherein the one or more acoustic devices comprise at least one of a speaker, a piezoelectric device, and an acoustic transducer.

4. The drilling system of claim 1, wherein the protrusions on the first plate mutually engage the dimples on the second plate during rotation of the second plate with a frequency that generates the vibration stress waves at the resonant frequency.

5. A method, comprising:

introducing a drill string into a wellbore that penetrates a subterranean formation, wherein the subterranean formation exhibits a resonant frequency and a drill bit is positioned at a distal end of the drill string;

rotating the drill bit to engage the subterranean formation;

generating vibration stress waves with a vibration sub positioned within the drill string adjacent the drill bit, wherein the vibration stress waves are generated at a vibration frequency that approximates the resonant frequency, and wherein the vibration sub comprises a housing disposed about a drive shaft that rotates the drill bit, a first plate fixed to the housing and including a first surface having protrusions, and a second plate rotationally fixed to the drive shaft and including a second surface having dimples;

rotating the second plate relative to the first plate as the drill bit rotates; and engaging the protrusions with the dimples such that the protrusions on the first plate move into and out of the dimples on the second plate for generating the vibration stress waves.

6. The method of claim 5, wherein generating the vibration stress waves with the vibration sub comprises generating acoustic vibration stress waves with one or more acoustic devices included in the vibration sub.

7. The method of claim 5, wherein the protrusions on the first plate mutually engage the dimples on the second plate during rotation of the second plate at a frequency that generates the vibration stress waves at the resonant frequency.

8. The method of claim 7, further comprising:

determining the resonant frequency of the subterranean formation prior to introducing the drill string into the wellbore; and selecting the first and second plates to respectively have the protrusions and the dimples that will generate the vibration stress waves at the resonant frequency.

9. The method of claim 5, further comprising:

determining the resonant frequency of a portion of the subterranean formation proximate the drill bit during drilling; and adjusting the vibration frequency to the resonant frequency of the portion of the subterranean formation proximate the drill bit.

10. The method of claim 9, wherein determining the resonant frequency of the portion of the subterranean formation proximate the drill bit comprises determining the resonant frequency of the portion of the subterranean formation proximate a side of the drill bit.

11. The method of claim 10, wherein adjusting the vibration frequency to the resonant frequency of the portion of the subterranean formation proximate the drill bit comprises adjusting the vibration frequency to the resonant frequency of the portion of the subterranean formation proximate the side of the drill bit.

* * * * *